US011255085B1

(12) United States Patent
Honeywell et al.

(10) Patent No.: US 11,255,085 B1
(45) Date of Patent: Feb. 22, 2022

(54) INSULATION FRAMING SYSTEMS, ASSEMBLIES, AND METHODS

(71) Applicant: The Steel Network, Inc., Durham, NC (US)

(72) Inventors: Richard Honeywell, Raleigh, NC (US); John C. Herrmann, Raleigh, NC (US); James E. Herrmann, Raleigh, NC (US)

(73) Assignee: The Steel Network, Inc., Durham, NC (US)

( * ) Notice: Subject to any disclaimer, the term of this patent is extended or adjusted under 35 U.S.C. 154(b) by 0 days.

(21) Appl. No.: 15/412,460

(22) Filed: Jan. 23, 2017

Related U.S. Application Data

(60) Provisional application No. 62/281,525, filed on Jan. 21, 2016.

(51) Int. Cl.

| | |
|---|---|
| ***E04C 2/38*** | (2006.01) |
| ***E04B 1/76*** | (2006.01) |
| ***E04B 1/80*** | (2006.01) |
| ***E04B 2/58*** | (2006.01) |

(52) U.S. Cl.
CPC ..... *E04B 1/7629* (2013.01); *E04B 1/80* (2013.01); *E04B 2/58* (2013.01)

(58) Field of Classification Search
CPC . E04B 1/78; E04B 1/24; E04B 1/7604; E04B 2/20; E04B 2/16; E04B 2/26; E04B 2001/7691; E04B 2001/742; E04C 1/40
See application file for complete search history.

(56) References Cited

U.S. PATENT DOCUMENTS

| | | | | |
|---|---|---|---|---|
| 1,810,597 A * | 6/1931 | Corwin | E04B 2/789 | 52/489.2 |
| 1,814,202 A * | 7/1931 | Winget | E04B 2/58 | 403/274 |
| 2,847,099 A * | 8/1958 | Gruber | E04C 2/08 | 52/481.1 |
| 3,452,500 A * | 7/1969 | Heirich | E04F 13/0812 | 52/478 |
| 3,807,106 A * | 4/1974 | Reinhardt | E04B 1/98 | 52/1 |
| 4,014,150 A * | 3/1977 | Wells | E04D 13/1637 | 52/461 |
| 4,107,887 A * | 8/1978 | Wendt | E04B 1/86 | 52/105 |
| 4,346,538 A * | 8/1982 | Ting | E04C 2/384 | 52/1 |

(Continued)

*Primary Examiner* — Basil S Katcheves
(74) *Attorney, Agent, or Firm* — Jenkins, Wilson, Taylor & Hunt, P.A.

(57) ABSTRACT

The present subject matter relates to systems, assemblies, and methods for the installation of insulation on the outside surface of exterior metal stud walls. In such systems, assemblies, and methods, an insulation framing element comprises an insulation support member configured to support an edge of one or more insulation layers, a frame coupling member extending from the insulation support member and configured for coupling to one or more frame elements of a structural support wall, and an insulation retention member extending from the insulation support member and configured to retain the edge of the one or more the insulation layers in a desired position with respect to the insulation support member.

11 Claims, 9 Drawing Sheets

(56) References Cited

U.S. PATENT DOCUMENTS 4,480,416 A * 11/1984 Judkins ..... E04F 13/0803 52/309.7
4,769,965 A * 9/1988 Shaub ..... E04B 9/241 52/506.07
4,920,719 A * 5/1990 Shaub ..... E04B 9/064 52/506.08
5,060,434 A * 10/1991 Allison ..... E04B 2/7411 52/238.1
5,315,803 A * 5/1994 Turner ..... E04B 2/706 248/351
5,701,709 A * 12/1997 Dixon, III ..... E04B 1/7604 52/404.1
5,992,114 A * 11/1999 Zelinsky ..... E04B 2/8652 249/216
7,225,590 B1 * 6/2007 diGirolamo ..... E04B 1/4178 52/379
7,963,491 B2 * 6/2011 Schouten ..... E04G 5/00 24/380
8,590,234 B2 * 11/2013 Groft ..... E04D 13/1618 52/302.1
9,371,645 B1 * 6/2016 Harkins ..... E04B 1/24
9,574,341 B2 * 2/2017 Ciuperca ..... E04B 1/625
9,689,162 B2 * 6/2017 Cullen ..... E04F 13/141
2004/0006934 A1 * 1/2004 Heydon ..... E04C 3/09 52/127.1
2005/0076611 A1 * 4/2005 Crawford ..... E04B 1/80 52/782.1
2009/0165410 A1 * 7/2009 Wuts ..... E04B 1/7612 52/302.1
2011/0197530 A1 * 8/2011 Bahnmiller ..... B32B 5/14 52/309.4
2013/0152498 A1 * 6/2013 Krause ..... E04F 13/0828 52/235
2015/0121787 A1 * 5/2015 Krause ..... E04F 13/0817 52/302.1

* cited by examiner

INSULATION FRAMING SYSTEMS, ASSEMBLIES, AND METHODS

PRIORITY CLAIM

The present application claims the benefit of U.S. Provisional Patent Application Ser. No. 62/281,525, filed Jan. 21, 2016, the disclosure of which is incorporated herein by reference in its entirety.

TECHNICAL FIELD

The subject matter disclosed herein relates generally to building systems. More particularly, the subject matter disclosed herein relates to systems, assemblies, and methods for insulation framing.

BACKGROUND

In the design of commercial buildings, insulation is commonly inserted only between the metal studs in a wall, and exterior sheathing is applied directly to these studs. Recent changes in the IECC Energy Conservation Code and ASHRAE Standard 90.1, however, necessitate the installation of 1 to 4 inches of continuous rigid insulation layer on the outside surface of exterior metal stud walls. Accordingly, code requirements now require that there has to be an additional layer of insulation, and that this added layer has to be continuous (i.e., not separated by studs), meaning that it has to sit on the outer surface of the studs in an uninterrupted fashion. Any exterior cladding/sheathing is placed directly on the rigid insulation, and fasteners have to go first through the sheathing, then the insulation, and finally into a stud flange.

This requirement presents several difficulties. Existing building component systems lack accommodation for cladding assemblies (e.g., cement board panels, siding, metal panels, EIFS, stucco, or the like) since there is no viable approach to attach to a stable substrate like plywood or gypsum sheathing over the thick rigid insulation layer other than long and unstable cantilevered screws. As an example, with a 4" thick piece of rigid insulation, the long fastener that is required is subjected to a substantial cantilevered load from the weight of the insulation and the sheathing. In addition, the challenge of blindly hitting the stud flange from so far away is a concern. For all practical purposes, it would be desirable to change the traditional method of cladded construction using certain popular sheathing materials due to the difficulty in accomplishing their attachment.

SUMMARY

In accordance with this disclosure, systems, assemblies, and methods for the installation of insulation on the outside surface of exterior metal stud walls are provided. In one aspect, an insulation framing element for use in an installation of insulation on an outside surface of a structural support wall is provided. In some embodiments, the insulation framing element comprises an insulation support member configured to support an edge of one or more insulation layers, a frame coupling member extending from the insulation support member and configured for coupling to one or more frame elements of a structural support wall, and an insulation retention member extending from the insulation support member and configured to retain the edge of the one or more the insulation layers in a desired position with respect to the insulation support member.

In another aspect, a framing system for use in an installation of insulation on an outside surface of a structural support wall is provided. In some embodiments, the framing system comprises a plurality of insulation framing elements configured for coupling to one or more frame elements of the structural support wall. Each of the plurality of insulation framing elements can comprise an insulation support member configured to support an edge of one or more insulation layers, an frame coupling member extending from the insulation support member and configured for coupling to the one or more frame elements of the structural support wall, and an insulation retention member extending from the insulation support member and configured to retain the edge of the one or more insulation layers in a desired position with respect to the insulation support member. In this configuration, the plurality of insulation framing elements can be configured to be spaced a distance from one another, the distance being selected such that each of the one or more insulation layers is held between two consecutive elements of the plurality of insulation framing elements.

In yet a further aspect, a method of installing insulation on an outside surface of a structural support wall is provided. In some embodiments, the method comprises coupling a first insulation framing element to one or more frame elements of the structural support wall, the first insulation framing element comprising a first insulation support member, a first frame coupling member extending from the first insulation support member and configured for coupling to the one or more frame elements of the structural support wall, and a first insulation retention member extending from the first insulation support member. The method can further comprise positioning one or more insulation layers against the structural support wall, wherein a first edge of one or more insulation layers is supported by the first insulation support member, and wherein the first edge of the one or more insulation layers is retained in a desired position with respect to the first insulation support member by the first insulation retention member. The method can additionally comprise coupling a second insulation framing element to one or more frame elements of the structural support wall, the second insulation framing element comprising a second insulation support member positioned to support a second edge of the one or more insulation layers, a second frame coupling member extending from the second insulation support member and configured for coupling to the one or more frame elements of the structural support wall, and a second insulation retention member extending from the second insulation support member and retaining the one or more insulation layers in a desired position with respect to the second insulation support member.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

The presently-disclosed subject matter addresses many of the difficulties presented by a requirement of continuous rigid insulation layer on the outside surface of exterior metal stud walls. In this regard, systems, connecting members, and methods for coupling continuous rigid insulation to a structural support wall are provided. In some embodiments, for example, the present subject matter provides an engineered installer-friendly set of steel framing tracks and angles designed to be an integral part of the continuous rigid insulation, and at the same time provide a stable component for direct substrate attachment.

Figure 1:
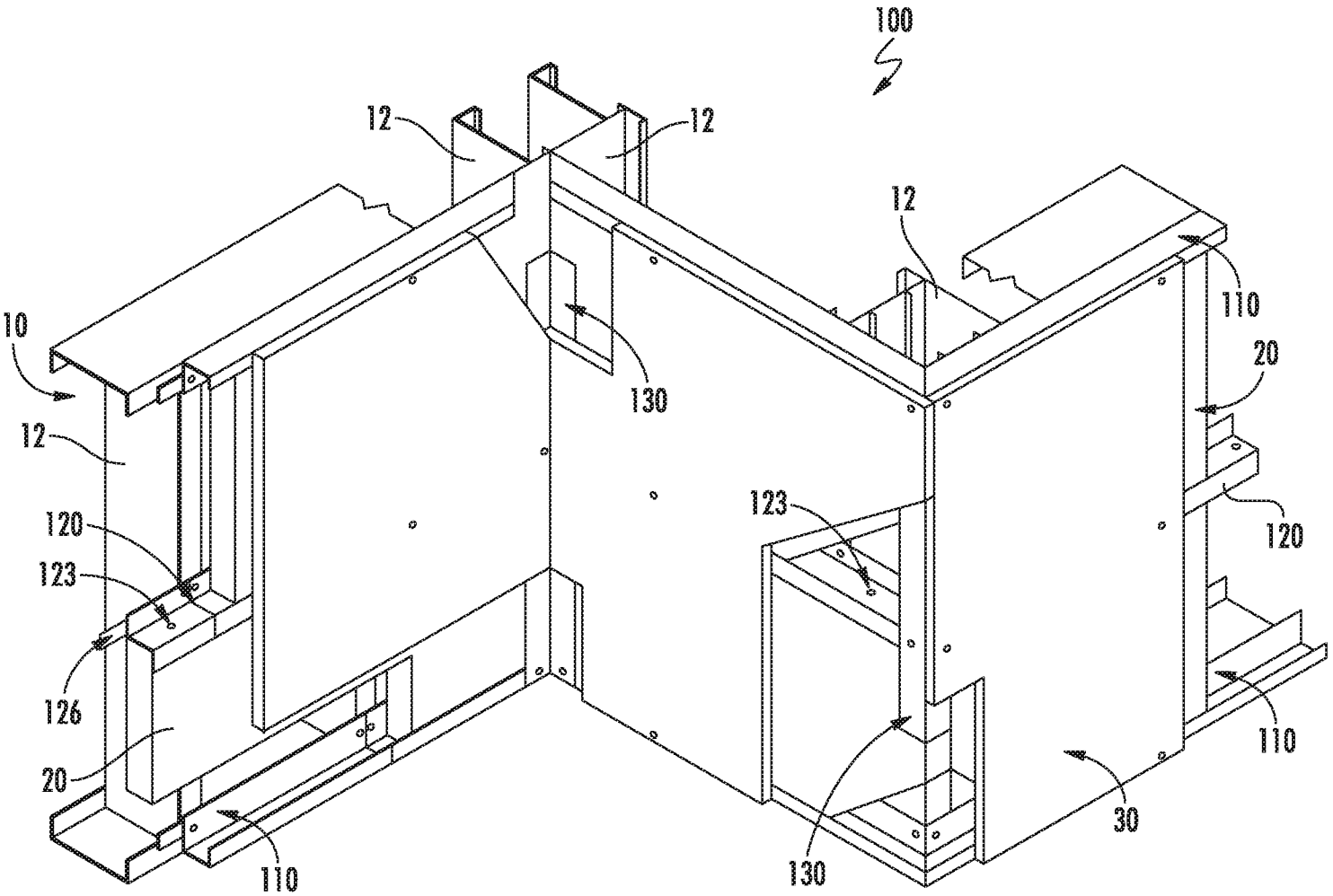
FIGS. 1 and 2 illustrate perspective side partial cutaway views of a structural support wall including an insulation framing system according to embodiments of the presently disclosed subject matter.
Figure 2:
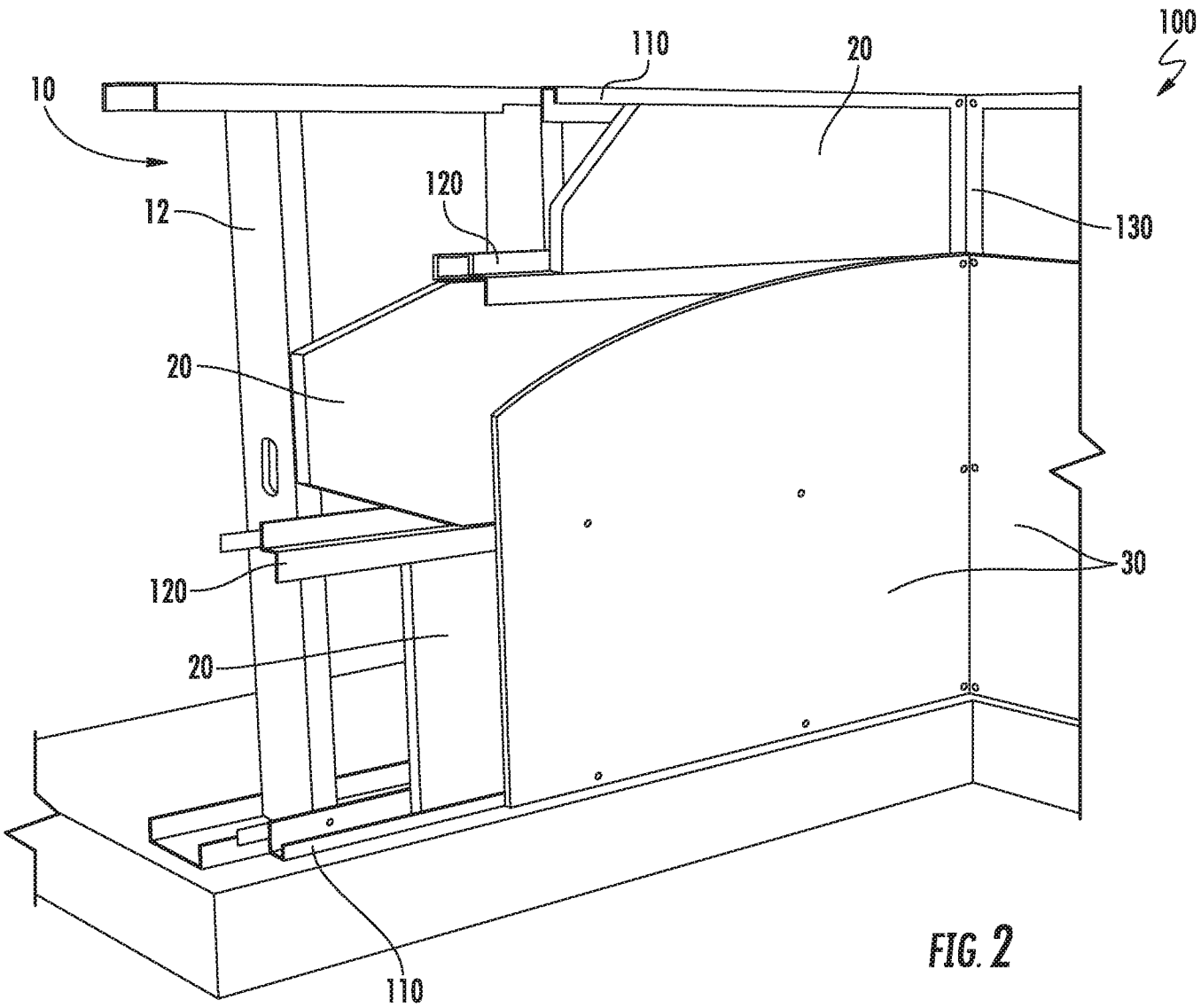

With reference to the particular configurations for the framing elements discussed herein and shown in FIGS. 1 and 2, exemplary arrangements are illustrated for a structural support wall, generally designated 10, which includes a plurality of frame elements 12. In some embodiments, for example, frame elements 12 are steel studs that are spaced apart at regular intervals along a length of structural support wall 10. To install one or more insulation layers (e.g., rigid foam insulation layers), generally designated 20, in a substantially continuous manner on an outside surface of structural support wall 10, in one aspect, the present subject matter provides an insulation framing system, generally designated 100, which includes a combination of one or more substantially J-shaped framing elements 110, one or more substantially Z-shaped framing elements 120, and/or one or more corner framing elements 130 that are coupled to frame elements 12 of structural support wall 10. In some embodiments, for example, the framing elements can be coupled directly to frame elements 12, and thus short fasteners (e.g., screws) may be used.

With this framing structure, insulation layers 20 can be received on top of or within one or more of substantially J-shaped framing elements 110, substantially Z-shaped framing elements 120, and/or corner elements 130. In addition, in some embodiments, one or more additional cladding materials are installed over insulation layers 20, including but not limited to one or more sheathing layers 30, moisture barriers, and/or exterior siding. In some embodiments, these additional elements are fastened to the framing elements directly, again only requiring short screws. In this way, rather than the fasteners being subjected to a cantilevered load, they are primarily subjected only to shear loads. To enable this connection arrangement, in some embodiments, the components of insulation framing system 100 are designed to be robust enough to support the weight of one or more of insulation layers 20, the cladding materials (e.g., sheathing layers 30), and wind loads. In addition, where the framing elements are configured to be fastened to frame elements 12 prior to the installation of insulation layers 20 and sheathing layers 30, the problem of blindly inserting a long fastener through the previously-used insulation and sheathing to the studs can be avoided.

Figure 3:
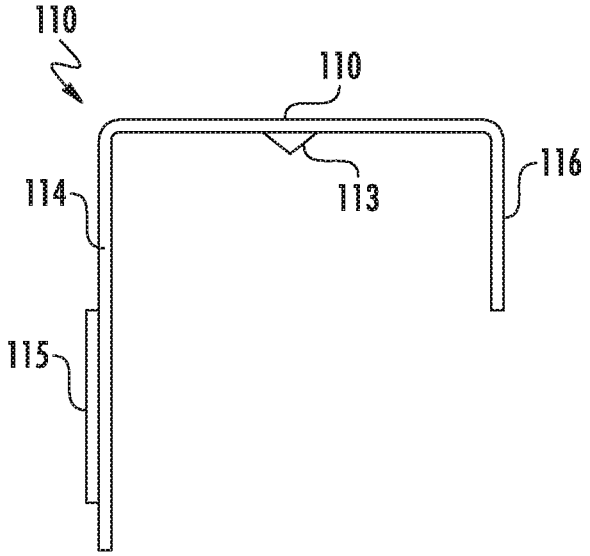
FIG. 3 illustrates a side view of a J-shaped framing element of an insulation framing system according to an embodiment of the presently disclosed subject matter.
Figure 4A:
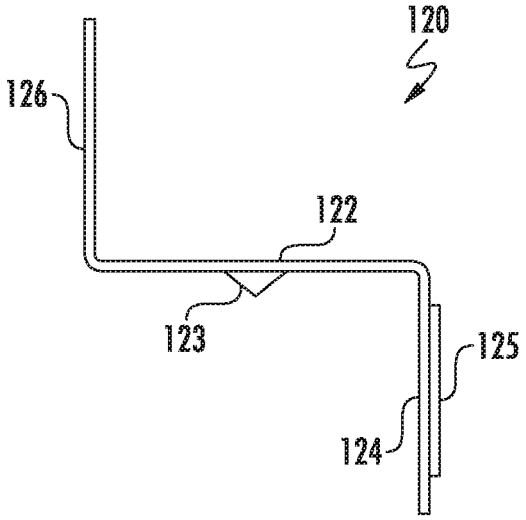
FIG. 4A illustrates a side view of a Z-shaped framing element of an insulation framing system according to an embodiment of the presently disclosed subject matter.
Figure 4B:
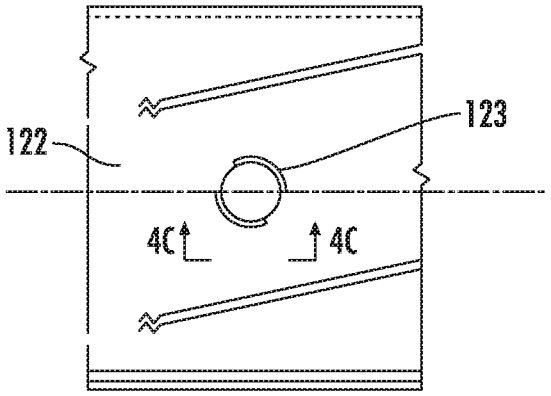
FIG. 4B illustrates a top view of an insulation support member of the Z-shaped framing element shown in FIG. 4A.
Figure 4C:
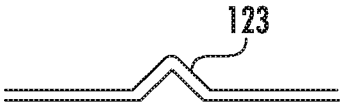
FIG. 4C illustrates a side view of an insulation engagement feature of the insulation support member of the Z-shaped framing element shown in FIGS. 4A and 4B.
Figure 6:
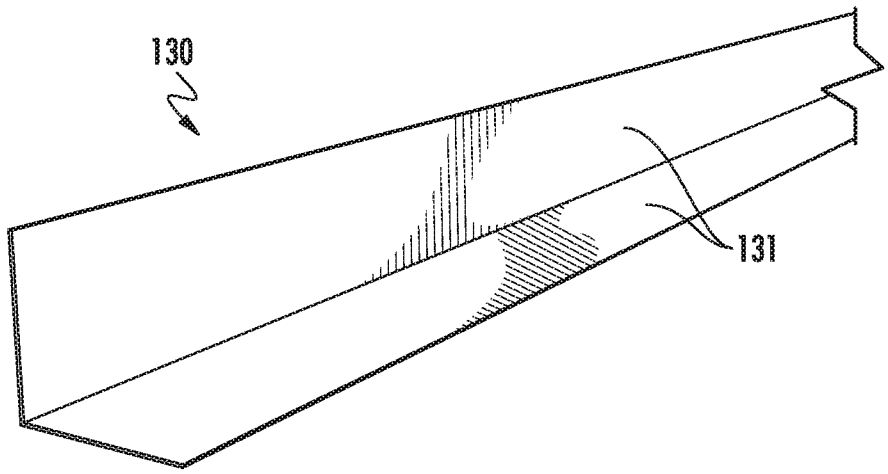
FIG. 6 illustrates a side view of a corner framing element of an insulation framing system according to an embodiment of the presently disclosed subject matter.

Regarding the particular configurations for the framing elements of insulation framing system 100 disclosed herein, FIG. 3 illustrates an embodiment of J-shaped framing elements 110, FIGS. 4A-4C illustrate an embodiment of Z-shaped framing elements 120, and FIG. 6 illustrates an embodiment of corner framing elements 130.

Referring to FIG. 3, in some embodiments, insulation framing system 100 comprises one or more substantially J-shaped framing elements 110, which is configured to secure one or more insulation layers 20 to one or more of frame elements 12 in a simple and fast way. In the illustrated embodiment, each of substantially J-shaped framing elements 110 includes a first insulation support member 112 configured to support an edge of one or more of insulation layers 20. In this regard, in some embodiments, first insulation support member 112 has a width that is selected to correspond to a depth/thickness of insulation layers 20 that are to be received by substantially J-shaped framing elements 110. In this regard the width of first insulation support member 112 can be between about 1.5 inches and 4 inches for many conventional insulation sizes, although those having ordinary skill in the art will recognize that first insulation support member 112 can be wider or narrower as desired for a particular application. Similarly, the length of substantially J-shaped framing elements 110 can be selected to be substantially similar to a length of insulation layers 20 or the length can be selected to be a standardized dimension (e.g., about 12 feet) that can be cut to a desired length as needed.

Substantially J-shaped framing elements 110 can further optionally comprise one or more insulation engagement features 113 (e.g., dimples, protrusions, surface textures) along a surface of first insulation support member 112 (e.g., every 8 inches along the length of first insulation support member 112), the one or more insulation engagement features 113 being configured to engage an edge of the one or more insulation layers 20.

A first frame coupling member 114 extends in a first direction from one edge of first insulation support member 112 (e.g., at a substantially 90 degree angle) and is configured for coupling to one or more frame elements 12 of structural support wall 10. In some embodiments, for example, first frame coupling member 114 features wide flanges (e.g., about 2.5 inches) for increased target area for installation of screws. Additionally, in some embodiments, a first thermal barrier 115 can be attached to first frame coupling member 114 to form an integrated thermal break between frame elements 12 and insulation layers 20. In some particular embodiments, for example, first thermal barrier 115 comprises a thermal tape (e.g., 3M™ Vinyl Foam Tape 4516, commercially available from 3M, St. Paul, Minn., United States of America) that is secured (e.g., adhesively bonded) to a surface of first frame coupling member 114 that is configured to be positioned against frame elements 12. Regardless of the particular configuration, first thermal barrier 115 helps to maintain the insulative properties of the whole system by isolating the metal components.

In addition, a first insulation retention member 116 extends from a second edge (e.g., opposite from the edge from which first frame coupling member 114 extends) of first insulation support member 112 (e.g., at a substantially 90 degree angle) in a direction that is substantially the same as the first direction that first frame coupling member 114 extends. In this configuration, first insulation retention member 116 is configured to retain an edge of the one or more insulation layers 20 in a desired position with respect to first insulation support member 112. In this way, first insulation retention member 116 can serve as a further insulation engagement feature that keeps insulation layers 20 sliding or popping out of place. In some embodiments, the width of first insulation retention member 116 (e.g., about 1-1.5 inches) is smaller than the width of the wide flanges of first frame coupling member 114 discussed above (e.g., about 2-2.5 inches). Accordingly, all together, first insulation support member 112, first frame coupling member 114, and first insulation retention member 116 can define a substantially J-shaped cross section.

Referring again to the embodiments shown in FIGS. 1 and 2, in some configurations for the insulation framing systems disclosed herein, substantially J-shaped framing elements 110 are installed at the top and/or bottom of structural support wall 10 to help define the upper and/or lower edges of the exterior wall surface. In such embodiments, first insulation support member 112 can be positioned substantially flush with a top or bottom of structural support wall 10, and first frame coupling member 114 and first insulation retention member 116 can extend "inwardly" in the direction of structural support wall 10.

Regardless of the particular configuration, in some embodiments, substantially J-shaped framing elements 110 can be formed from mill-certified high strength steel and added galvanized coating layer. In some embodiments, for example, exemplary materials can be ASTM A1103/A1103M Structural Grade 50 (340) Type H, ST50H (ST340H): 50 ksi (340 MPa) minimum yield strength, 65 ksi (450 MPa) minimum tensile strength, 54 mil minimum thickness (16 gauge, 0.0566" design thickness) with ASTM A653/A653M G90 (Z275) hot dipped galvanized coating. Those having ordinary skill in the art will recognize, however, that one or more of these material properties and/or dimensions may be modified to suit a particular application while still embodying the concepts disclosed herein.

Referring next to FIGS. 4A-4C, one or more substantially Z-shaped framing elements 120 can be used instead of or in combination with substantially J-shaped framing elements 110. Similar to the framing elements discussed above, substantially Z-shaped framing elements 120 can comprise an second insulation support member 122, a second frame coupling member 124, and an second insulation retention member 126. In some embodiments, insulation support member 122 can have a width selected to support insulation layers 20 having a defined depth/thickness, second frame coupling member 124 can have wide flanges (e.g., about 1.5 inches) for increased target area for installation of screws, and second insulation retention member 126 can have a width (e.g., about 1.5 inches) that is sufficient to serve as an engagement feature for keeping rigid insulation from sliding or popping out of place. In some embodiments, a second thermal barrier 125 (e.g., a vinyl foam thermal tape) can be attached (e.g., adhesively coupled) to second frame coupling member 124 to form an integrated thermal break between frame elements 12 and insulation layers 20. Substantially Z-shaped framing elements 120 can be provided in any of a variety of lengths selected to be substantially similar to a length of insulation layers 20 or to be a standardized dimension (e.g., about 12 feet) that can be cut to a desired length as needed.

In contrast to substantially J-shaped framing elements 110, however, substantially Z-shaped framing elements 120 can be configured such that second frame coupling member 124 extends from a first edge of second insulation support member 122 in a first direction (e.g., at a substantially 90 degree angle), whereas second insulation retention member 126 extends from a second edge (e.g., opposing the first edge from which second frame coupling member 124 extends) of second insulation support member 122 in a second direction (e.g., at a substantially 90 degree angle) substantially opposing the first direction. In this way, second insulation support member 122, second frame coupling member 124, and second insulation retention member 126 together define a substantially Z-shaped cross section.

Referring again to FIGS. 1 and 2, in some embodiments, substantially Z-shaped framing elements 120 can be installed between adjacent sections of insulation layers 20 (e.g., between abutting edges of coplanar sections of insulation layers 20). In some embodiments, for example, where insulation layers 20 are sized such that a plurality of panels of insulation layers 20 (e.g., each having a height of about 24 inches) are arranged in a vertical array over the exterior of structural support wall 10, substantially Z-shaped framing elements 120 can be positioned at correspondingly regular intervals (e.g., every 24 inches) along the height of structural support wall 10.

In this arrangement, substantially Z-shaped framing elements 120 can be configured to support an edge of one or more first insulation layers 20 on either side of second insulation support member 122. In particular, for example, on one side of second insulation support member 122, second insulation retention member 126 can act as an engagement feature for keeping insulation layers 20 from sliding or popping out of place. In addition, to hold one or more insulation layers 20 in place against an opposing side of second insulation support member 122, second insulation support member 122 can incorporate one or more insulation engagement features 123 (e.g., dimples, protrusions, surface textures) along a surface of second insulation support member 122 (e.g., every 8 inches along the length of second insulation support member 122), the one or more insulation engagement features 123 being configured to engage an edge of the one or more insulation layers 20.

In any configuration, exemplary materials for these framing elements can be ASTM A1103/A1103M Structural Grade 50 (340) Type H, ST50H (ST340H): 50 ksi (340 MPa) minimum yield strength, 65 ksi (450 MPa) minimum tensile strength, 54 mil minimum thickness (16 gauge, 0.0566" design thickness) with ASTM A653/A653M G90 (Z275) hot dipped galvanized coating. Those having ordinary skill in the art will recognize, however, that one or more of these material properties and/or dimensions may be modified to suit a particular application while still embodying the concepts disclosed herein.

Figure 5:
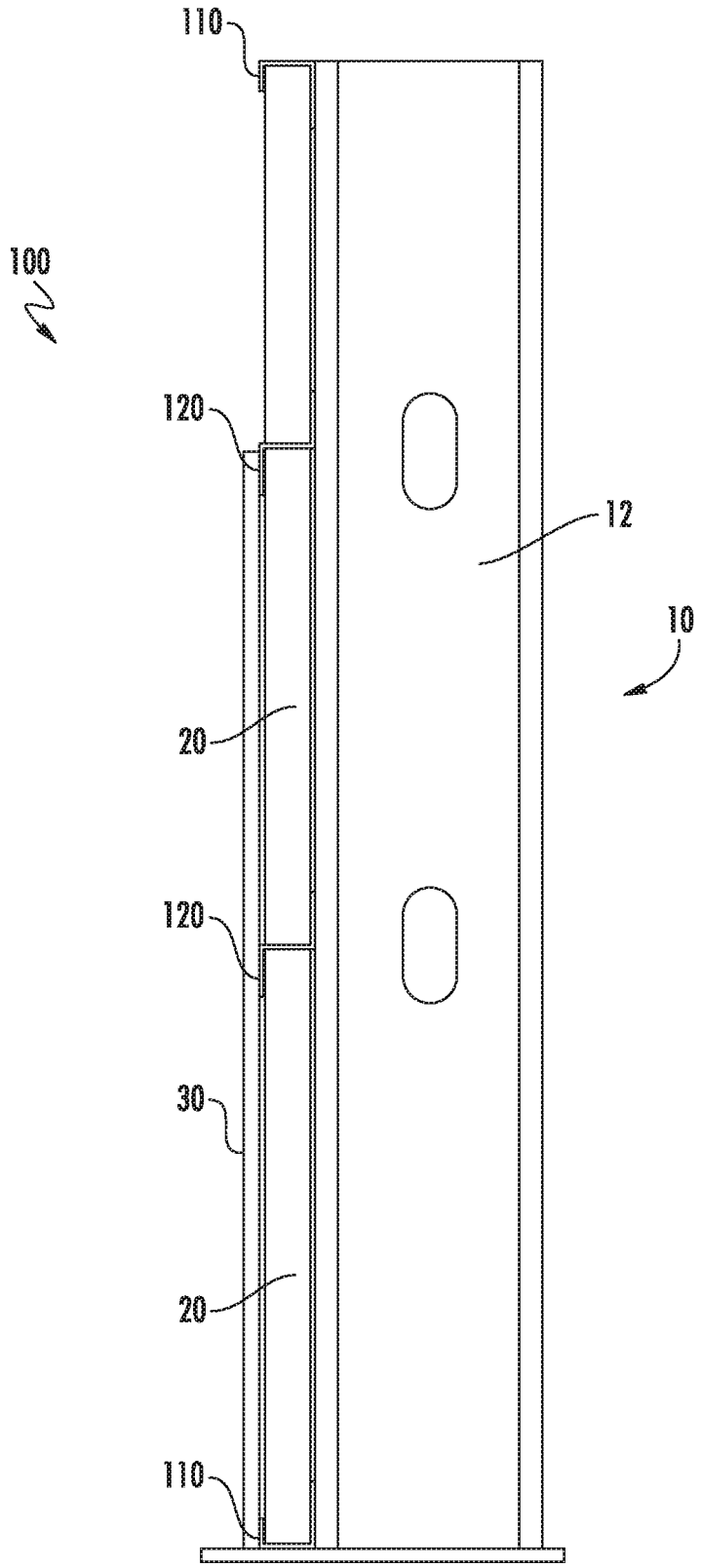
FIG. 5 is a side view of a structural support wall including an insulation framing system according to embodiments of the presently disclosed subject matter.

When used in combination, substantially J-shaped framing elements 110 and substantially Z-shaped framing elements 120 can secure a plurality of insulation layers 20 against a structural support wall 10 in a substantially continuous stacked arrangement. As illustrated in FIG. 5, for example, in some embodiments, substantially J-shaped framing elements 110 can be secured to frame elements 12 both at a base position and at a crown position with respect to structural support wall 10 (see FIGS. 1 and 2), and substantially Z-shaped framing elements 120 can be secured to frame elements 12 at defined intervals between substantially J-shaped framing elements 110. With this arrangement of framing elements, a plurality of insulation layers 20 can be secured between sequential framing elements in a substantially continuous manner against structural support wall 10. Furthermore, exterior sheathing layers 30 can be secured to substantially J-shaped framing elements 110 and substantially Z-shaped framing elements 120 (e.g., using fasteners) to cover and further secure insulation layers 20 in place.

Referring again to FIGS. 1 and 2, in addition to substantially J-shaped framing elements 110 and/or substantially Z-shaped framing elements 120, the present insulation framing system 100 can further include multi-purpose corner framing elements 130 (e.g., 90° angle element), which can be used in a variety of framing applications, including soffits, floor and ceiling runners, and wall bridging. Specifically, for example, in some embodiments, corner framing elements 130 can be attached to an assembled combination of J-shaped framing elements 110, Z-shaped framing elements 120, and insulation layers 20 to define, support, and/or reinforce angled connections of walls to soffits, ceilings, floors, and/or abutting walls. In some embodiments, the addition of corner framing elements 130 is performed prior to sheathing layers 30 being fastened to the framing elements. Corner framing elements 130 can be provided in any of a variety of lengths but in some embodiments can be provided with a standardized dimension (e.g., about 10 feet) that can be cut to a desired length as needed.

Referring to FIG. 6, in some embodiments, corner framing elements 130 can comprise two substantially equal-width legs 131 such that corner framing elements 130 have a substantially V-shaped cross-section.

Alternatively, in some embodiments, legs 131 can have unequal lengths such that the cross-sectional shape of corner framing elements 130 is substantially L-shaped. In any configuration, legs 131 can be sufficiently wide (e.g., about 2 inches) such that they provide an increased target area for screws to hit. In addition, such corner framing elements 130 can likewise be manufactured from mill-certified, galvanized steel (e.g., ASTM A1103/A1103M Structural Grade 50 (340) Type H, ST50H (ST340H): 50 ksi (340 MPa) minimum yield strength, 65 ksi (450 MPa) minimum tensile strength, 54 mil minimum thickness (16 gauge, 0.0566" design thickness) with ASTM A653/A653M G90 (Z275) hot dipped galvanized coating). Those having ordinary skill in the art will recognize, however, that one or more of these material properties and/or dimensions may be modified to suit a particular application while still embodying the concepts disclosed herein.

In another aspect, the present subject matter provides a method of installing insulation on an outside surface of structural support wall 10.

Figure 7A:
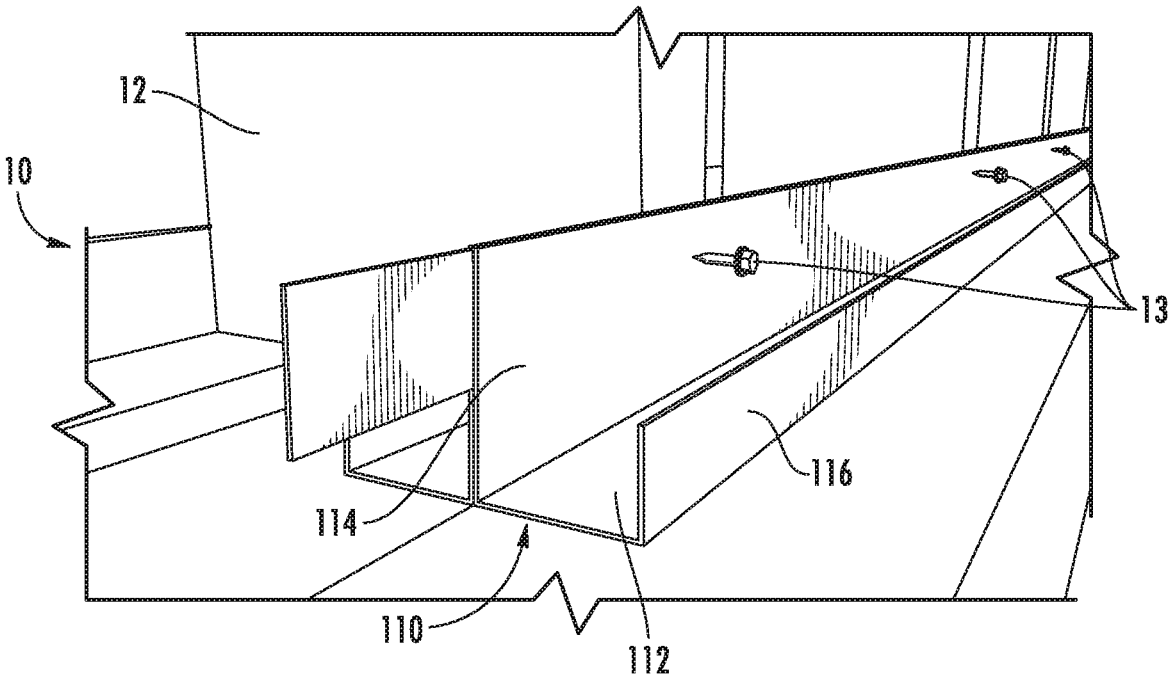
FIGS. 7A through 7H illustrate steps in an installation of an insulation framing system according to an embodiment of the presently disclosed subject matter.
Figure 7B:
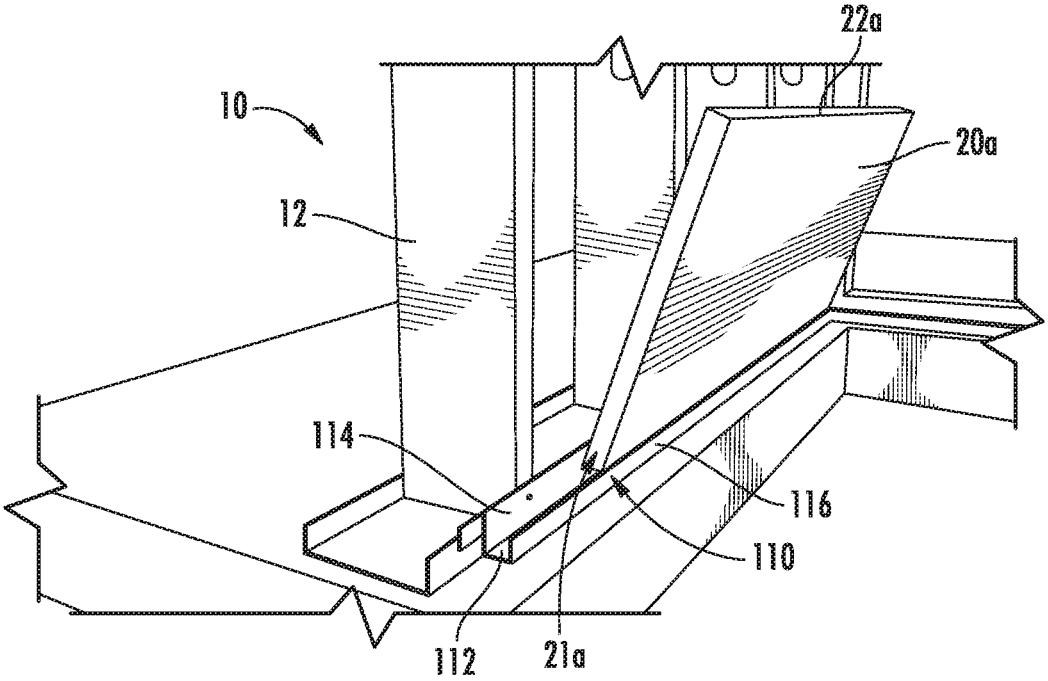

Referring to FIGS. 7A-7H, steps in an exemplary process for installing insulation is presented. In some embodiments, the method includes coupling a first insulation framing element to one or more frame elements 12 of structural support wall 10. As illustrated in FIG. 7A, for example, the first insulation framing element can comprise one of substantially J-shaped framing elements 110, which comprises first insulation support member 112, first frame coupling member 114 extending from first insulation support member 112 and coupled to the one or more frame elements 12 of structural support wall 10 (e.g., using one or more fasteners 13), and first insulation retention member 116 extending from first insulation support member 112. This one of substantially J-shaped framing elements 110 can be installed at a base of structural support wall 10 to help define a bottom edge of the wall. Referring to FIG. 7B, with substantially J-shaped framing elements 110 in place, one or more first insulation layers **20*a* (e.g., a panel of rigid foam insulation having a height of approximately 24 inches) can be inserted into substantially J-shaped framing elements 110 and positioned against structural support wall 10, wherein a first edge 21*a* of the one or more first insulation layers 20*a* is supported by first insulation support member 112, and wherein the first edge 21*a* of the one or more first insulation layers 20*a* is retained in a desired position with respect to first insulation support member 112 by first insulation retention member 116**.

Figure 7C:
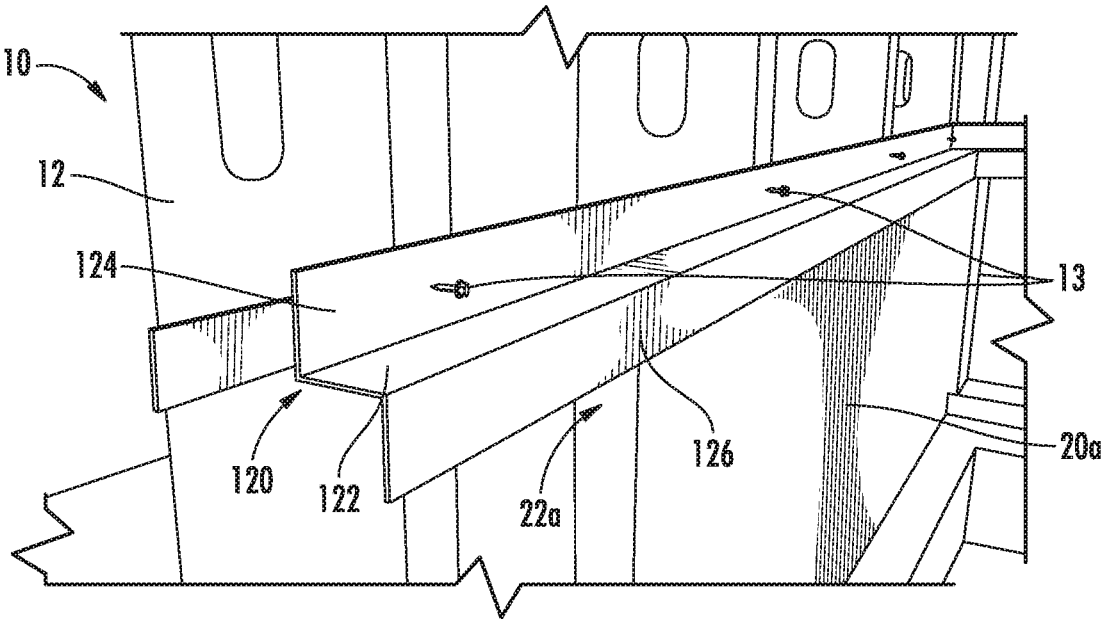

Referring next to FIG. 7C in conjunction with FIG. 7B, with this section of first insulation layers **20*a* in place, a second insulation framing element can be coupled to one or more frame elements 12 of the structural support wall 10. In the process step illustrated in FIG. 7C, for example, this second insulation framing element can comprise one of substantially Z-shaped framing elements 120, which comprises second insulation support member 122 positioned to support a second edge 22*a* of the one or more first insulation layers 20*a*, second frame coupling member 124 extending from second insulation support member 122 and coupled to the one or more frame elements 12 of structural support wall 10 (e.g., using fasteners 13), and second insulation retention member 126 extending from second insulation support member 122 and retaining the one or more first insulation layers 20*a* in a desired position with respect to second insulation support member 122 (e.g., by engaging second edge 22*a* of first insulation layers 20*a***).

Figure 7D:
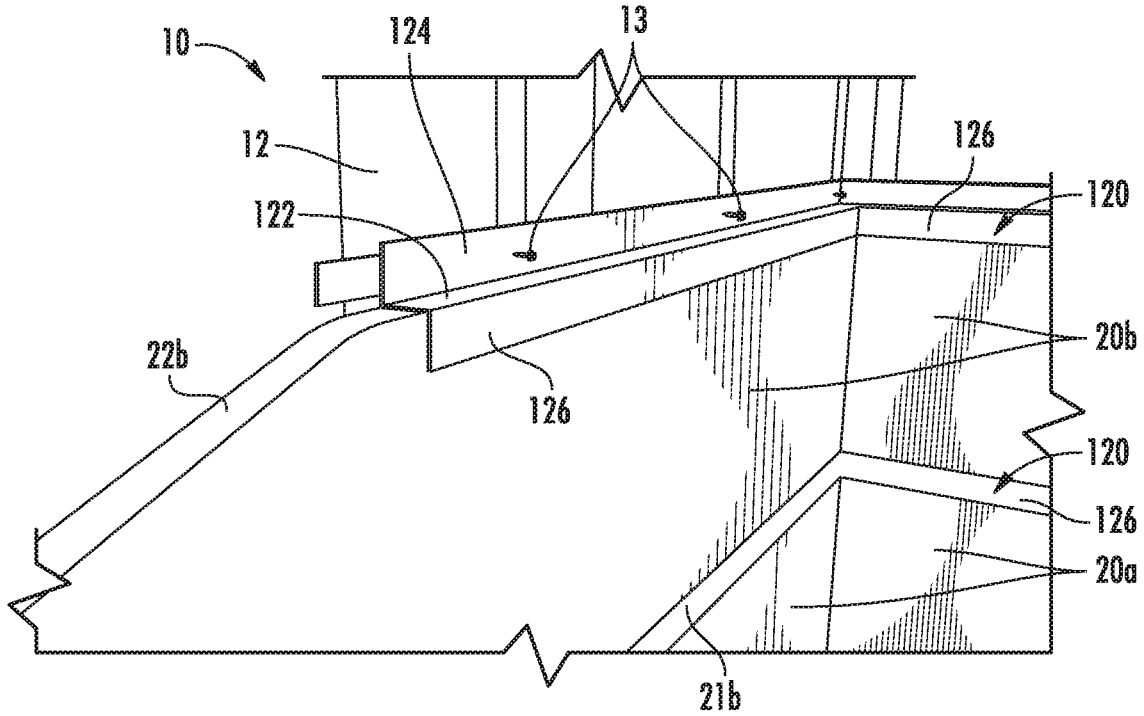

Depending on the height of first insulation layers **20*a* and/or the total height of structural support wall 10, additional insulation layers can be installed sequentially to form a substantially continuous insulation layer over the exterior of structural support wall 10. As shown in FIG. 7D, for example, one or more second insulation layers 20*b* can be positioned against structural support wall 10, wherein a first edge 21*b* of the one or more second insulation layers 20*b* is supported by second insulation support member 122. In some embodiments, positioning the one or more second insulation layers 20*b* with their first edge 21*b* supported by second insulation support member 122 can include engaging the first edge 21*b* of the one or more second insulation layers 20*b* with insulation engagement features 123 (best seen in FIGS. 1, 4A and 4C). In this way, whereas second insulation retention member 126 is shown extending downwardly to retain an upper edge of the previously-installed one or more first insulation layers 20*a* in a desired position with respect to second insulation support member 122, the one or more second insulation layers 20*b* can be at least temporarily retained in place with respect to second insulation support member 122 during the installation phase by insulation engagement features 123. With the one or more second insulation layers 20*b* in the desired position, further substantially Z-shaped framing elements 120 can be installed to secure the one or more second insulation layers 20*b* in place (e.g., by engaging a second edge 22*b* of second insulation layers 20*b*) in a manner substantially similar to that shown and described with reference to FIG. 7C**.

Figure 7E:
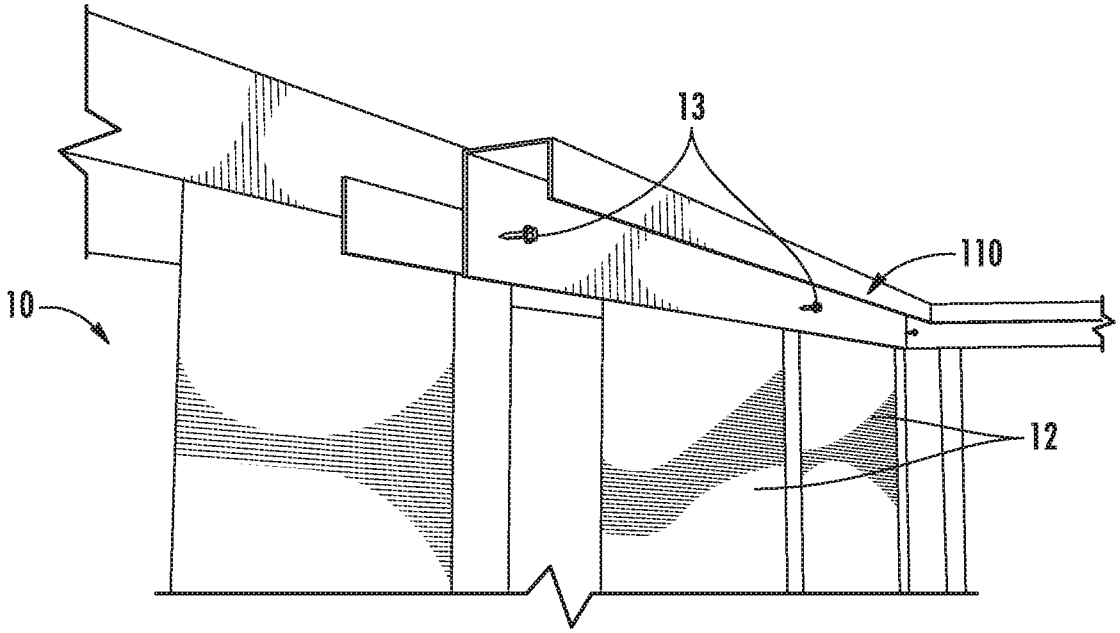
Figure 7F:
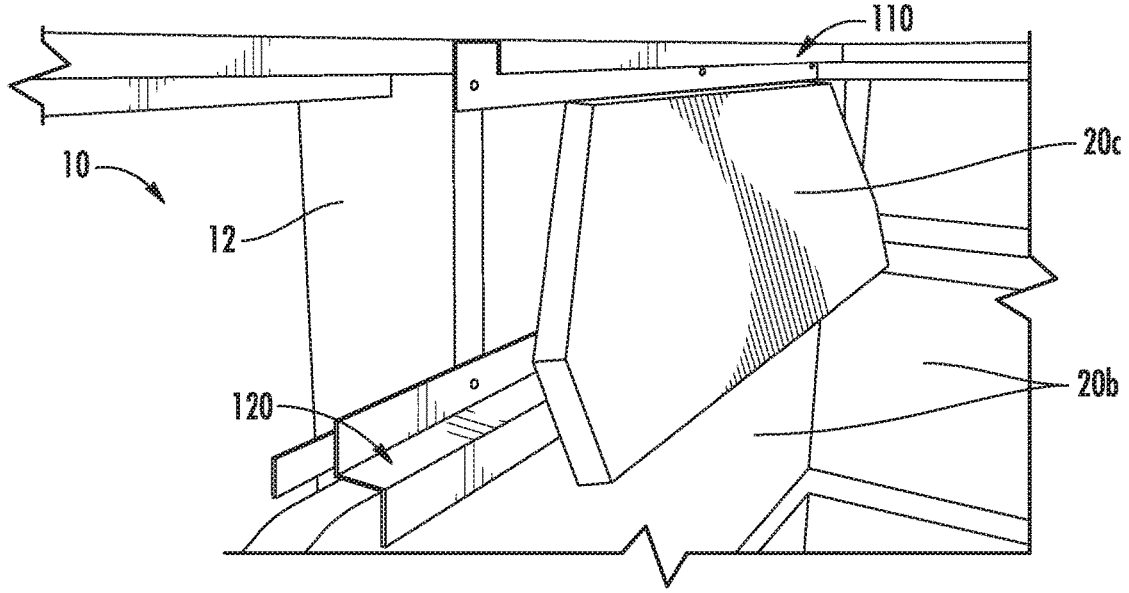

Prior to installing the uppermost insulation layers, a further framing element can be installed at a head of structural support wall 10. Referring to FIGS. 7E and 7F, for example, a substantially J-shaped framing element 110 is coupled to the one or more frame elements 12 of structural support wall 10 (e.g., using one or more fasteners 13). This one of substantially J-shaped framing elements 110 can be installed at a head of structural support wall 10 to help define a top edge of the wall. With this additional substantially J-shaped framing elements 110 in place, one or more third insulation layers 20*c* can be inserted between the substantially J-shaped framing element 110 installed at the head of structural support wall 10 and the previously-installed substantially Z-shaped framing element 120 as shown in FIG. 7F.

Figure 7G:
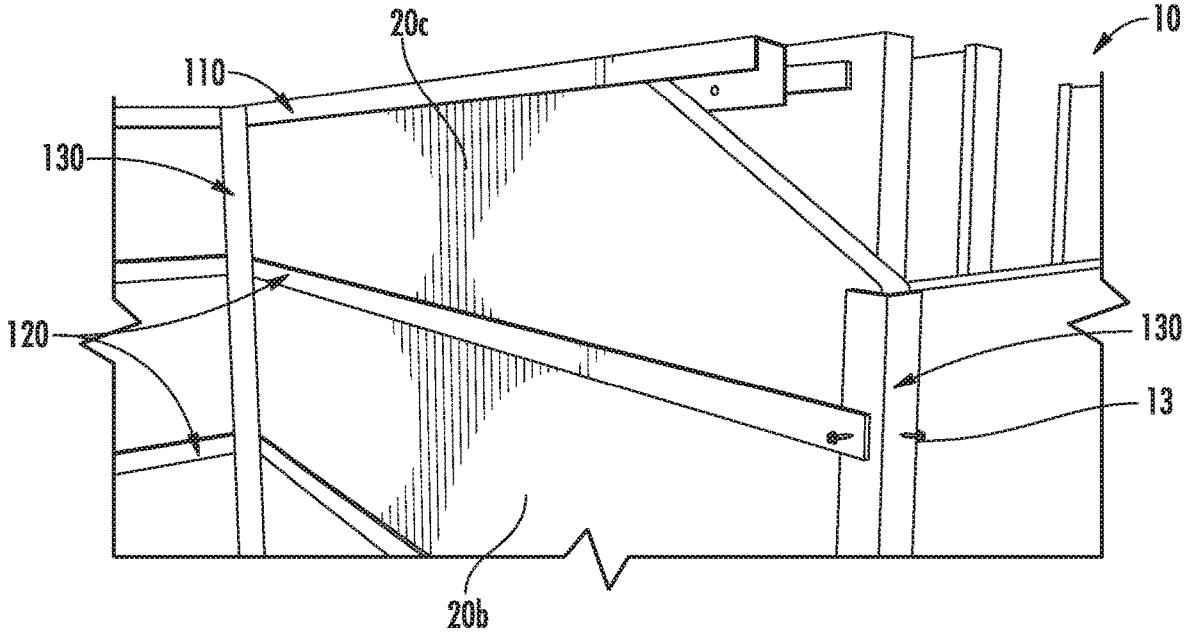
Figure 7H:
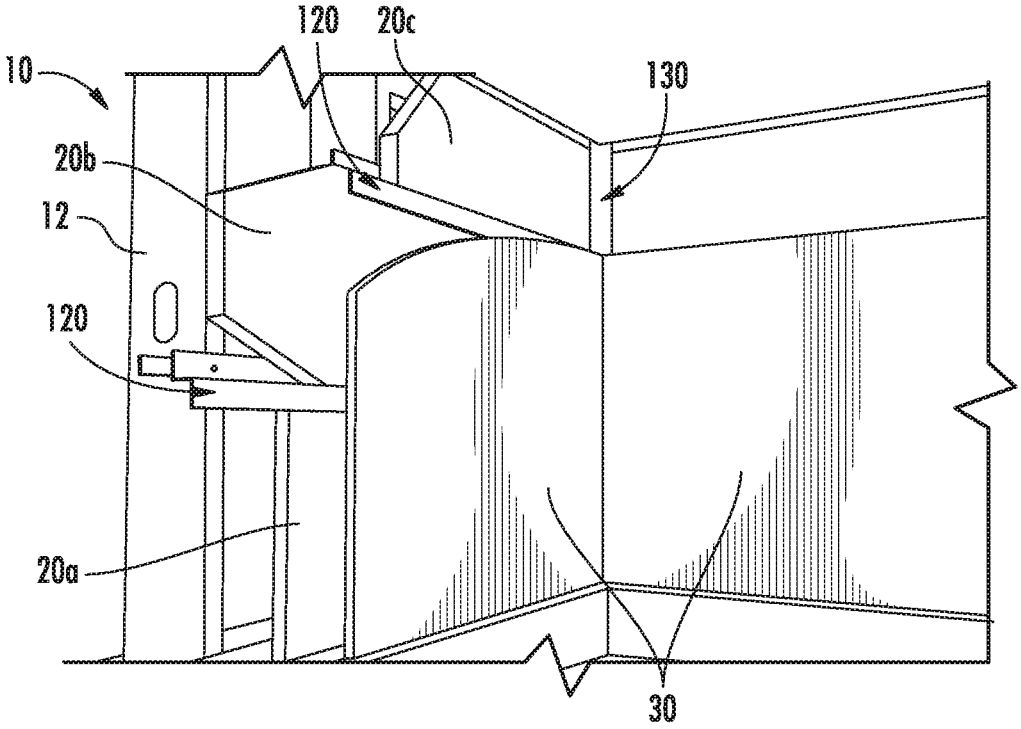

Referring now to FIGS. 7G and 7H, once the entire exterior of structural support wall 10 is covered by insulation, such as by mounting one or more first, second, and third insulation layers 20*a*, 20*b*, and 20*c* to structural support wall 10 as discussed above, one or more corner framing elements 130 can be coupled to insulation framing system 100 to define, support, and/or reinforce angled connections of walls to soffits, ceilings, floors, and/or abutting walls. Finally, the insulation layers can be covered and further secured in place by installing one or more sheathing layers 30 over the insulation layers and the framing elements as illustrated in FIG. 7H.

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. An insulation framing element for use in an installation of insulation on an outside surface of a plurality of frame elements that are spaced apart at regular intervals along a length of a structural support wall comprising:

an insulation support member configured to support an edge of one or more insulation layers, wherein a series of spaced portions of the insulation support member protrudes outwardly from a first surface of the insulation support member to define one or more surface features, wherein the one or more surface features each comprises a triangular dimple depressed into a second surface of the insulation support member opposing the first surface such that the one or more surface features protrude outwardly from the first surface to engage the edge of the one or more insulation layers;

a frame coupling member extending from the insulation support member and configured to be arranged transversely with respect to the plurality of frame elements for coupling directly to the plurality of frame elements along the length of the structural support wall; and an insulation retention member extending from the insulation support member and configured to retain the edge of the one or more the insulation layers in a desired position with respect to the insulation support member;

wherein the insulation framing element is formed from steel; and wherein the insulation retention member is configured such that when a sheathing layer is fastened to the insulation retention member, the sheathing layer is positioned to cover and secure the one or more insulation layers in place.

2. The insulation framing element of claim 1, wherein the frame coupling member extends in a first direction from a first edge of the insulation support member at a substantially 90 degree angle, and the insulation retention member extends in the first direction from a second edge of the insulation support member at a substantially 90 degree angle;

wherein the insulation support member, the frame coupling member, and the insulation retention member together define a substantially J-shaped cross section.

3. The insulation framing element of claim 1, wherein the frame coupling member extends in a first direction from a first edge of the insulation support member at a substantially 90 degree angle, and the insulation retention member extends in a second direction substantially opposing the first direction from a second edge of the insulation support member at a substantially 90 degree angle;

wherein such the insulation support member, the frame coupling member, and the insulation retention member together define a substantially Z-shaped cross section.

4. The insulation framing element of claim 1, further comprising a thermal barrier attached to the frame coupling member and configured to prevent direct contact between the frame coupling member and the plurality of frame elements.

5. The insulation framing element of claim 4, wherein the thermal barrier comprises an insulating tape.

6. A framing system for use in an installation of insulation on an outside surface of a structural support wall comprising:

a plurality of frame elements that are spaced apart at regular intervals along a length of the structural support wall;

a plurality of insulation framing elements arranged transversely with respect to the plurality of frame elements and coupled to the plurality of frame elements along the length of the structural support wall, each of the plurality of insulation framing elements comprising:

an insulation support member configured to support an edge of one or more insulation layers, wherein a series of spaced portions of the insulation support member protrudes outwardly from a first surface of the insulation support member to define one or more surface features, wherein the one or more surface features each comprises a triangular dimple depressed into a second surface of the insulation support member opposing the first surface such that the one or more surface features protrude outwardly from the first surface to engage the edge of the one or more insulation layers;

a frame coupling member extending from the insulation support member and configured for coupling directly to the plurality of frame elements of the structural support wall; and an insulation retention member extending from the insulation support member and configured to retain the edge of the one or more insulation layers in a desired position with respect to the insulation support member;

wherein each of the plurality of the insulation framing elements is formed from steel; and one or more sheathing layers fastened to the insulation retention member of the plurality of insulation framing elements;

wherein the plurality of insulation framing elements are configured to be spaced a distance from one another, the distance being selected such that each of the one or more insulation layers is held between two consecutive elements of the plurality of insulation framing elements; and wherein the one or more sheathing layers are positioned to cover and secure the one or more insulation layers in place.

7. The framing system of claim 6, wherein the frame coupling member extends in a first direction from a first edge of the insulation support member at a substantially 90 degree angle, and the insulation retention member extends in the first direction from a second edge of the insulation support member at a substantially 90 degree angle;

wherein the insulation support member, the frame coupling member, and the insulation retention member together define a substantially J-shaped cross section.

8. The framing system of claim 6, wherein the frame coupling member extends in a first direction from a first edge of the insulation support member at a substantially 90 degree angle, and the insulation retention member extends in a second direction substantially opposing the first direction from a second edge of the insulation support member at a substantially 90 degree angle;

wherein such the insulation support member, the frame coupling member, and the insulation retention member together define a substantially Z-shaped cross section.

9. The framing system of claim 6, further comprising a corner framing element configured for coupling to the plurality of insulation fray framing elements at a junction between the structural support wall and a soffit, ceiling, floor, or additional wall that abuts the structural support wall.

10. A method of installing insulation on an outside surface of a structural support wall, the method comprising:

coupling a first insulation framing element to a plurality of frame elements that are spaced apart at regular intervals along a length of the structural support wall, the first insulation framing element comprising:

a first insulation support member, wherein a series of spaced portions of the first insulation support member protrudes outwardly from a first surface of the first insulation support member to define one or more surface features, wherein the one or more surface features each comprises a triangular dimple depressed into a second surface of the insulation support member opposing the first surface such that the one or more surface features protrude outwardly from the first surface;

a first frame coupling member extending from the first insulation support member and configured to be arranged transversely with respect to the plurality of frame elements for coupling directly to the plurality of frame elements along the length of the structural support wall; and a first insulation retention member extending from the first insulation support member;

wherein the first insulation framing element is formed from steel;

positioning one or more insulation layers against the structural support wall, wherein a first edge of one or more insulation layers is supported by the first insulation support member and engaged by the one or more surface features, and wherein the first edge of the one or more insulation layers is retained in a desired position with respect to the first insulation support member by the first insulation retention member;

coupling a second insulation framing element to the plurality of frame elements of the structural support wall, the second insulation framing element comprising:

a second insulation support member positioned to support a second edge of the one or more insulation layers;

a second frame coupling member extending from the second insulation support member and configured to be arranged transversely with respect to the plurality of frame elements for coupling to the plurality of frame elements along the length of the structural support wall; and a second insulation retention member extending from the second insulation support member and retaining the one or more insulation layers in a desired position with respect to the second insulation support member;

wherein the second insulation framing element is formed from steel; and fastening one or more sheathing layers to the insulation retention member of the first insulation framing element and the second insulation framing element, wherein the one or more sheathing layers are positioned to cover and secure the one or more insulation layers in place.

11. The method of claim 10, further comprising coupling a corner framing element to the first insulation framing element and the second insulation framing element at a junction between the structural support wall and a soffit, ceiling, floor, or additional wall that abuts the structural support wall.

* * * * *